US006382319B1

(12) United States Patent
Hill, Jr. et al.

(10) Patent No.: US 6,382,319 B1
(45) Date of Patent: May 7, 2002

(54) METHOD AND APPARATUS FOR OPEN HOLE GRAVEL PACKING

(75) Inventors: Leo E. Hill, Jr., Huffman; Christian F. Bayne, The Woodlands, both of TX (US)

(73) Assignee: Baker Hughes, Inc., Houston, TX (US)

( * ) Notice: Subject to any disclaimer, the term of this patent is extended or adjusted under 35 U.S.C. 154(b) by 0 days.

(21) Appl. No.: 09/550,439

(22) Filed: Apr. 17, 2000

Related U.S. Application Data

(63) Continuation-in-part of application No. 09/359,245, filed on Jul. 22, 1999, now Pat. No. 6,203,901.
(60) Provisional application No. 60/093,714, filed on Jul. 22, 1998.

(51) Int. Cl.[7] ..... E21B 43/08
(52) U.S. Cl. ..... 166/278; 166/51; 166/194; 166/377
(58) Field of Search ..... 166/51, 194, 278, 166/312, 377

(56) References Cited

U.S. PATENT DOCUMENTS

| | | | | | |
|---|---|---|---|---|---|
| 3,952,804 | A | | 4/1976 | Smyrl | |
| 4,295,524 | A | * | 10/1981 | Baker et al. | 166/278 |
| 4,700,777 | A | * | 10/1987 | Luers | 166/51 X |
| 4,915,172 | A | * | 4/1990 | Donovan et al. | 166/278 |
| 5,069,280 | A | * | 12/1991 | McKee et al. | 166/278 |
| 5,327,960 | A | * | 7/1994 | Cornette et al. | 166/51 |
| 5,333,688 | A | | 8/1994 | Jones et al. | |
| 5,373,899 | A | | 12/1994 | Dore et al. | |
| 5,505,260 | A | * | 4/1996 | Anderson et al. | 166/278 |
| 5,609,204 | A | * | 3/1997 | Rebardi et al. | 166/51 |
| 5,676,208 | A | * | 10/1997 | Finley | 166/278 |
| 5,971,070 | A | * | 10/1999 | Ross et al. | 166/278 |
| 5,975,205 | A | * | 11/1999 | Carisella | 166/278 |
| 6,230,801 | B1 | * | 5/2001 | Hill, Jr. et al. | 166/278 |

OTHER PUBLICATIONS

Duhon et al., Halliburton Energy Services, "New Completion Techniques Applied to a Deepwater Gulf of Mexico TLP Completion Successfully Gravel Pack an Openhole Horizontal Interval of 2400 Feet," XP–002120001, OTC Proceedings, 1998 Offshore Technology Conference (13 pages).

* cited by examiner

*Primary Examiner*—George Suchfield
(74) *Attorney, Agent, or Firm*—Madan, Mossman & Sriram, PC

(57) ABSTRACT

The apparatus includes a gravel pack assembly comprising a gravel pack body and a crossover tool. The crossover tool comprises auxiliary flow chambers and channels around a casing packer and a crossover tool check valve. The gravel pack body and crossover tool are assembled coaxially as a cooperative unit by a threaded joint. The assembly is threadably attached to the bottom end of a tool string for selective placement within the wellbore. Set of the packer secures the gravel pack body to the well casing and seals the casing annulus around the gravel pack assembly. After setting the packer, the tool string is rotated to release the threaded assembly joint between the crossover tool and the gravel pack extension. The desired flow function is determined by selective axial positionment of the crossover tool within the gravel pack body. When the gravel pack is in place, the crossover tool is axially positioned to flush residual aggregate from the tool string bore. The gravel pack body is dedicated to the wellbore and the crossover tool withdrawn and replaced by a production tube.

22 Claims, 8 Drawing Sheets

METHOD AND APPARATUS FOR OPEN HOLE GRAVEL PACKING

CROSS-REFERENCE TO RELATED APPLICATIONS

This application is a continuation-in-part of U.S. application Ser. No. 09/359,245, now U.S. Pat. No. 6,203,901, filed Jul. 22, 1999, said Ser. No. 09/359,245 having a priority date of Jul. 22, 1998 based upon U.S. Provisional Application Serial No. 60/093,714.

BACKGROUND OF THE INVENTION

This invention generally relates to a method of hydrocarbon well completion and the associated apparatus for practicing the method. More particularly, the invention provides an open hole gravel packing system wherein a positive hydrostatic pressure differential within the well borehole is maintained against the production formation walls throughout all phases of the gravel packing procedure.

DESCRIPTION OF THE PRIOR ART

To extract hydrocarbons such as natural gas and crude oil from the earth's subsurface formations, boreholes are drilled into hydrocarbon bearing production zones. To maintain the productivity of a borehole and control the flow of hydrocarbon fluids from the borehole, numerous prior art devices and systems have been employed to prevent the natural forces from collapsing the borehole and obstructing or terminating fluid flow therefrom. One such prior art system provides a full depth casement of the wellbore whereby the wellbore wall is lined with a steel casing pipe that is secured to the bore wall by an annulus of concrete between the outside surface of the casing pipe and the wellbore wall. The steel casing pipe and surrounding concrete annulus is thereafter perforated by ballistic or pyrotechnic devices along the production zone to allow the desired hydrocarbon fluids to flow from the producing formation into the casing pipe interior. Usually, the casing interior is sealed above and below the producing zone whereby a smaller diameter production pipe penetrates the upper seal to provide the hydrocarbon fluids a smooth and clean flowing conduit to the surface.

Another prior art well completion system protects the well borewall production integrity by a tightly packed deposit of aggregate comprising sand, gravel or both between the raw borewall and the production pipe thereby avoiding the time and expense of setting a steel casing from the surface to the production zone which may be many thousands of feet below the surface. The gravel packing is inherently permeable to the desired hydrocarbon fluid and provides structural reinforcement to the bore wall against an interior collapse or flow degradation. Such well completion systems are called "open hole" completions. The apparatus and process by which a packed deposit of gravel is placed between the borehole wall and the production pipe is encompassed within the definition of an "open hole gravel pack system." Unfortunately, prior art open hole gravel pack systems for placing and packing gravel along a hydrocarbon production zone have been attended by a considerable risk of precipating a borehole wall collapse due to fluctuations in the borehole pressure along the production zone. These pressure fluctuations are generated by surface manipulations of the downhole tools that are in direct fluid circulation within the well and completion string.

Open hole well completions usually include one or more screens between the packed gravel annulus and a hydrocarbon production pipe. The term "screen" as used herein may also include slotted or perforated pipe. If the production zone is not at the bottom terminus of the well, the wellbore is closed by a packer at the distal or bottom end of the production zone to provide bottom end support for the gravel pack volume. The upper end of the production zone volume is delineated by a packer around the annulus between the wellbore and the pipe column, called a "completion string", that to, carries the hydrocarbon production to the surface. This upper end packer may also be positioned between the completion string and the inside surface of the well casing at a point substantially above the screens and production zone.

Placement of these packers and other "downhole" well conditioning equipment employs a surface controlled column of pipe that is often characterized as a "tool string". With respect to placement of a gravel pack, a surface controlled mechanism is incorporated within the tool string that selectively directs a fluidized slurry flow of sand and/or gravel from within the internal pipe bore of the tool string into the lower annulus between the raw wall of the wellbore and the outer perimeter of the completion string. This mechanism is positioned along the well depth proximate of the upper packer. As the mechanism directs descending slurry flow from the tool string bore into the wellbore annulus, it simultaneously directs the rising flow of slurry filtrate that has passed through screens in a production pipe extended below the upper packer. This rising flow of slurry filtrate is directed from the production pipe bore into the wellbore annulus above the upper packer.

It is during the interval of manually manipulated change in the slurry flow direction that potential exists for creating a hydrostatic pressure environment within the wellbore annulus below the upper packer that is less than the natural hydrostatic pressure of fluid within the formation. Such a pressure imbalance, even briefly, may collapse the borehole or otherwise damage the productivity of the production zone borehole wall or damage the filter cake. Highly deviated or horizontal production zone boreholes are particularly susceptible to damage due to such a pressure imbalance. Consequently, it is an object of the present invention to provide a flow cross-over mechanism that will provide a positive (overburden) pressure against a borehole wall throughout all phases of the gravel packing process.

It is also an object of the present invention to provide an apparatus design that facilitates a substantially uniform overburden pressure within a borehole production zone throughout the cross-flow changes occurring during a gravel packing procedure.

SUMMARY OF THE INVENTION

A preferred embodiment of the present invention includes a gravel pack extension tube that is permanently secured within a wellbore casing; preferably in or near the well production zone thereof. Near the upper end of the gravel pack extension tube is a packing seal that obstructs fluid flow through an annular section of the casing between the internal casing wall and the external perimeter of the gravel pack extension tube. The lower end of the gravel pack extension tube includes an open bore pipe that may be extended below the casing bottom and along the open borehole into the production zone. The distal end of the lower end pipe is preferably closed with a bull plug. Along the lower end of the pipe extension, within the hydrocarbon production zone and above the bull plug, are one or more gravel screens that are sized to pass the formation fluids while excluding the formation debris.

Internally, the upper end of the gravel pack extension tube provides two, axially separated, circular seal surfaces having an annular space there between. Further along the gravel pack extension tube length, several, three for example, axially separated, axial indexing lugs are provided to project into the extension tube bore space as operator indicators.

The dynamic or operative element of the present packing apparatus is a crossover flow tool that is attached to the lower end of a tool string. Concentric axial flow channels around the inner bore channel are formed in the upper end of the upper end of the crossover flow tool. An axial indexing collet is secured to the crossover tool assembly in the axial proximity of the indexing lugs respective to the extension tube. A ball check valve rectifies the direction of fluid flow along the inner bore of the crossover flow tool. A plurality of transverse fluid flow ports penetrate through the outer tube wall into the concentric flow channels. Axial positionment of the crossover flow tool relative to the inner seals on the gravel pack extension seals controls the direction of fluid flow within the concentrically outer flow channels. At all times and states of flow direction within the gravel packing procedure and interval, the production zone bore wall is subjected to at least the fluid pressure head standing in the wellbore above the production zone by means of the transverse flow channels and the concentric outer flow channels.

BRIEF DESCRIPTION OF THE DRAWINGS

For a thorough understanding of the present invention, reference is made to the following detailed description of the preferred embodiment, taken in conjunction with the accompanying drawings, in which like elements have been given like reference characters throughout the several figures of the drawings.

DETAILED DESCRIPTION OF THE PREFERRED EMBODIMENTS

Figure 1:
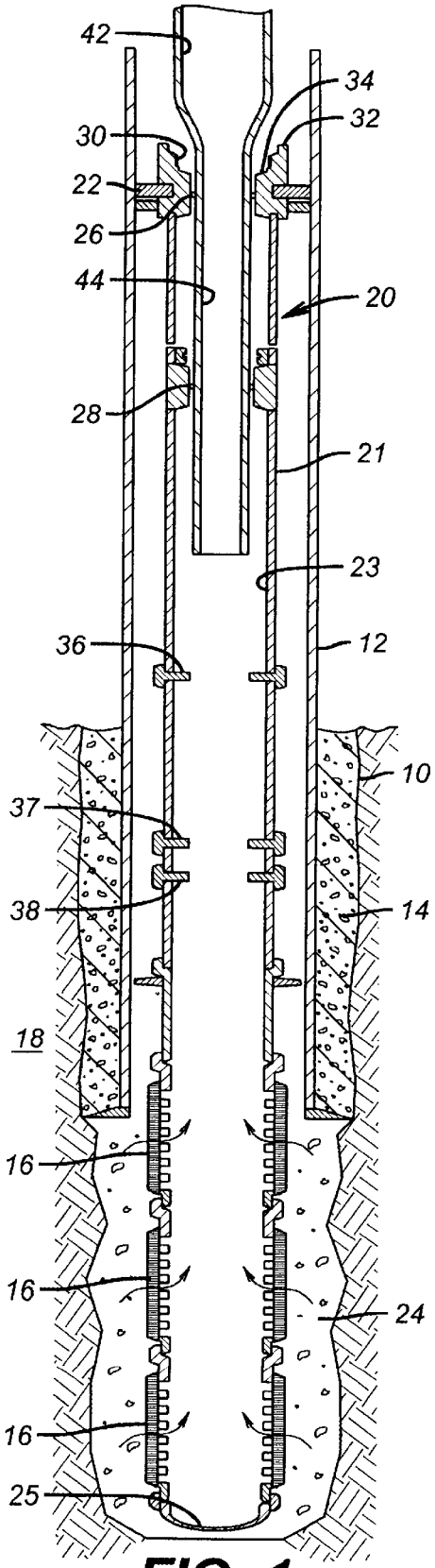
FIG. 1 is a sectional elevation of a completed oil well borehole having the present invention gravel pack extension secured therein.

The sectional elevation of FIG. 1 illustrates a hydrocarbon producing well having an upper casing 12. The well casing 12 is preferably secured to the wall 10 of the wellbore by an annular concrete jacket 14. Near the lower end of the casing 12, within the internal bore of the casing, a gravel pack body 20 is secured by slips and a pressure seal packer 22. Generally, the gravel pack body is an open flowpipe 21 having one or more cylindrical screen elements 16 near the lower end thereof. The flowpipe lower end projects into the hydrocarbon bearing production zone 18. In the annular space between the wellbore wall 10 and the screen elements 16 is a tightly consolidated deposit 24 of aggregate such as sand and gravel, for example. This deposit of aggregate is generally characterized in the art as a "gravel pack". Although tightly consolidated, the gravel pack is highly permeable to the hydrocarbon fluids desired from the formation production zone. Preferably, the gravel pack 24 surrounds all of the screen 16 flow transfer surface and extends along the borehole length substantially coextensively with the hydrocarbon fluid production zone. The flowpipe lower end is terminated by a bull plug 25, for example.

Component Description

The upper end of the gravel pack body 20 comprises a pair of internal pipe sealing surfaces 26 and 28 which are short lengths of substantially smooth bore, internal pipe wall having a reduced diameter. These internal sealing surfaces 26 and 28 are separated axially by a discreet distance to be subsequently described with respect to the crossover tool 50.

The upper end of the gravel pack body 20 also integrates a tool joint thread 30, a tool shoulder 32 and a limit ledge 34. Below the pipe sealing surfaces 26 and 28 along the length of the gravel pack extension tube 23 are three collet shifting profiles 36, 37 and 38. The axial separation dimensions between the pipe sealing surfaces 26 and 28 are also critically related to the axial separation distances between collet shifting ledges 36, 37 and 38 as will be developed more thoroughly with regard to the crossover tool 50.

Hydrocarbon production fluid flow, therefore, originates from the production zone 18, passes through the gravel pack 24 and screens 16 into the internal void volume of the flowpipe 21. From the screens 16, the fluid enters and passes through the terminal sub 44 and into the production pipe 42. The production pipe 42 carries the fluid to the surface where it is appropriately channeled into a field gathering system.

The aggregate constituency of the gravel pack 24 is deposited in the wellbore annulus as a fluidized slurry. Procedurally, the slurry is pumped down the internal pipe bore of a completion string that is mechanically manipulated from the surface. Generally, completion string control movement includes only rotation, pulling and, by gravity, pushing. Consequently, with these control motions the slurry flow must be transferred from within the completion string bore into the annulus between the wellbore wall and the gravel pack extension flow pipe 21 above the screens 16. The screens 16 separate the fluid carrier medium (water, for example) from the slurry aggregate as the carrier medium enters the internal bore of the flow pipe 21. The flow pipe channels the carrier medium return flow up to a crossover point within the completion string where the return flow is channeled into the annulus between the internal casing walls 12 and the outer wall surfaces of the completion string. From the crossover point, the carrier medium flow is channeled along the casing annulus to the surface.

Figure 2:
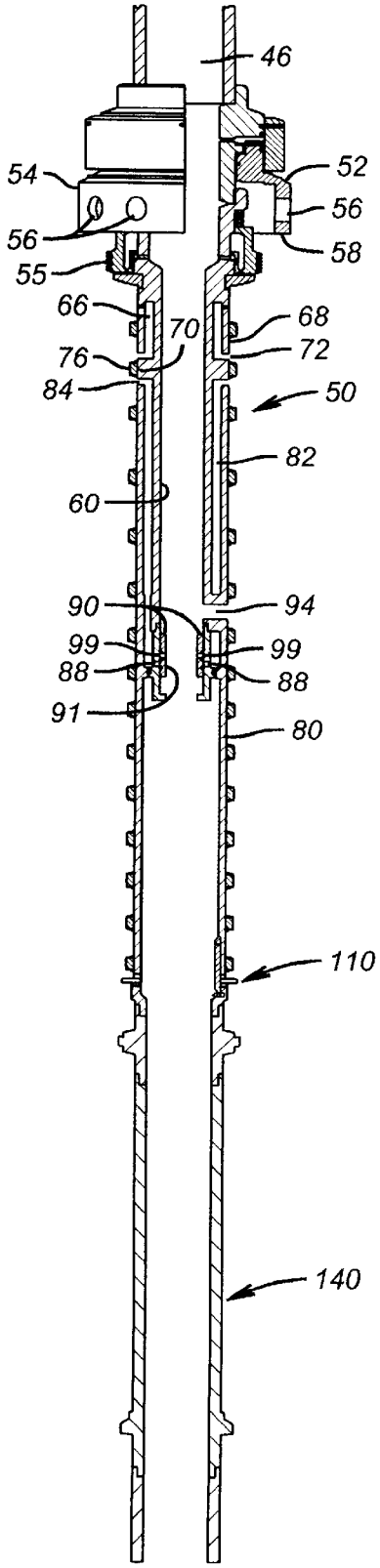
FIG. 2 is a sectional elevation of the present invention crossover tool.

When the desired quantity of gravel pack is in place, the internal bore of the completion string must be flushed with a reverse flow circulation of carrier medium to remove aggregate remaining in the completion string above the crossover point. Such reverse flow is a carrier medium flow that descends along the carrier annulus to the cross-over point and up the completion string bore to the surface. Throughout each of the flow circulation reversals, it is necessary that a net positive pressure be maintained against the producing zone of the wellbore to prevent any borewall collapse. To this objective, a crossover tool 50 as illustrated by FIG. 2 is constructed to operatively combine with the gravel pack body 20.

Generally, the crossover tool 50 assembles coaxially with the gravel pack body 20 and includes a setting tool 52 that is attached to the lower end of the completion string 46. The setting tool 52 comprises a collar 54 having a lower rim face 58 that mates with the tool shoulder 32 of the gravel pack body 20 when the crossover tool 50 is structurally unitized by a mutual thread engagement 55 with the gravel pack body 20. Transverse apertures 56 perforate the collar 54 perimeter.

Internally of the collar 54 rim, an inner tube 60 is structurally secured therewith. As best seen from the detail of FIGS. 5 and 6, a thread collar 62 surrounds the upper end of the inner tube 60 to provide an upper void chamber 64 between the thread collar 62 and the tube 60. The thread collar 62 is perforated for fluid pressure transmission between the collar apertures 56 and the void chamber 64. Fluid pressure transmission channels are also provided between the void chamber 64 and an upper by-pass chamber 66. The upper by-pass chamber 66 is an annular void space between the inner tube 60 and an outer lip tube 68. Axially, the upper by-pass chamber 66 is terminated by a ring-wall 70. An upper by-pass flow channel 72 opens the chamber 66 to the outer volume surrounding the outer lip tube 68. An upper o-ring 74 seals the annular space between the outer lip tube 68 and the inner sealing surface 26 of the packer 22. The outer perimeter of the ring-wall 70 carries o-ring 76 for the same purpose when the crossover tool 50 is axially aligned with the sealing surface 26.

A lower sleeve 80 coaxially surrounds the innertube 60 below the ring-wall 70 to create a lower by-pass chamber 82. A lower by-pass flow channel 84 opens the chamber 82 to the outer volume surrounding the lower sleeve 80. O-ring 86 cooperates with the packer sealing surface 26 and the o-ring 76 to selectively seal the lower by-pass flow channel 84.

At the lower end of the inner tube 60, a check valve ball seat 90 is provided on an axially translating sleeve 91. The seat 90 is oriented to selectively obstruct downward fluid flow within the inner tube 60. Upward flow within the tube is relatively unobstructed since a cooperative check valve ball 92 is uncaged. Upward fluid flow carries the check valve ball away from the seat 90 and upward along the tool string 46 bore. Above the check valve seat 90 is a crossover port 94 between the bore of the inner tube 60 and the outer volume surrounding the lower sleeve 80. O-rings 96 and 98 cooperate with the lower seal bore 102 of the lower seal ring 100 to isolate the crossover port 94 when the crossover tool is correspondingly aligned. Below the check valve seat 90 are by-pass flow channels 99 in the sleeve 91 and flow channels 88 in the inner tube 60. When aligned by axial translation of the sleeve 91, the flow channels 88 and 99 open a fluid pressure communication channel between the lower by-pass chamber 82 and the internal bore of the lower sleeve 80 below the valve seat 90. Alignment translation of the sleeve 91 occurs as a consequence of the hydraulic pressure head on the sleeve 91 when the ball 92 is seated. By-pass flow channels 29 are also provided through the wall of gravel pack extension tube 23 between the inside sealing surfaces 26 and 28 of the packer body 20.

Below the lower sleeve 80 but structurally continuous with the crossover tool assembly are an anti-swabbing tool 110 and an axial indexing collet 150. The purpose of the anti-swabbing tool is to control well fluid loss into the formation after the gravel packing procedure has been initiated but not yet complete. The axial indexing collet 140 is a mechanism that is manipulated from the surface by selective up or down force on the completion string that positive locate the several relative axial positions of the crossover tool 50 to the gravel pack body 20.

Figure 3:
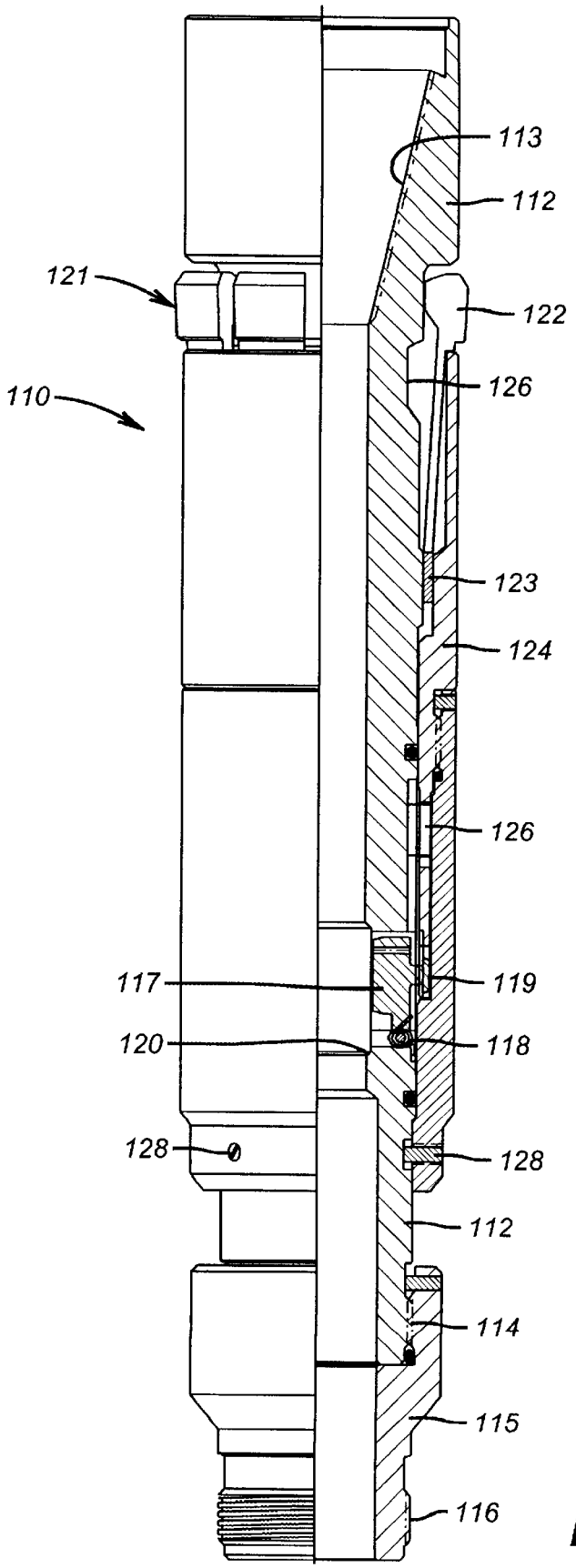
FIG. 3 is a partially sectioned elevation of an anti-swabbing tool having combination utility with the present invention.

In reference to FIG. 3, the anti-swabbing tool 110 comprises a mandrel 112 having internal box threads 113 for upper assembly with the lower sleeve 80. The mandrel 112 is structurally continuous to the lower assembly thread 114. At the lower end of the mandrel 112, it is assembled with a bottom sub 115 having external pin threads 116. Within the mandrel 112 wall is a retaining recess for a pivoting check valve flapper 117. The flapper 117 is biased by a spring 118 to the down/closed position upon an internal valve seat 120. However, the flapper is normally held in the open position by a retainer button 119. The retainer button is confined behind a selectively sliding key slot 126 that is secured to a sliding housing sleeve 124. The housing sleeve 124 normally held at the open position by shear screws 128. At the upper end of the housing sleeve 124 is an operating collet 121 having profile engagement shoulders 122 and an abutment base 123. A selected up-stroke of the completion string causes the collet shoulders 122 to engage an internal profile of the completion string. Continued up-stroke force presses the collet abutment base 123 against an abutment shoulder on the housing sleeve. This force on the housing sleeve shears the screws 128 thereby permitting the housing sleeve 124 and key slot 126 to slide downward and release the flapper 117. The downward displacement of the housing sleeve also permits the collet 121 and collet shoulders 122 to be displaced along the mandrel 112 until the profile of the collet shoulders 122 falls into the mandrel recess 126. When retracted into the recess 126, the shoulder 122 perimeter is sufficiently reduced to pass the internal activation profile thereby allowing the device to be withdrawn from the well after the flapper has been released.

Coaxial alignment of the crossover tool 50 with the gravel pack body 20 is largely facilitated by the axial indexing collet 140 shown by FIG. 4A–4E. The collet 140 is normally secured to the lower end of the crossover tool 50 and below the anti-swabbing tool 110. With respect to FIG. 4, a structurally continuous mandrel 142 includes exterior surface profiles 146 and 148. The profile 146 is a cylinder cam follower pin. The profile 148 is a collet finger blocking shoulder. Both profiles 146 and 148 are radial projections from the cylindrical outer surface of the mandrel 142. Confined between two collars 152 and 154 is a sleeve collet 144 and a coiled compression spring 150. The bias of spring 150 is to urge the collet sleeve downward against the collar 154.

Characteristic of the collet 144 is a plurality of collet fingers 147 around the collet perimeter. The fingers 147 are integral with the collet sleeve annulus at opposite finger ends but are laterally separated by axially extending slots between the finger ends. Consequently, each finger 147 has a small degree of radial flexure between the finger ends. About midway between the finger ends, each finger is radially profiled, internally and externally, to provide an internal bore enlargement 149 and an external shoulder 148. The outside diameter of the collet shoulder section 148 is dimensionally coordinated to the inside diameter of the indexing profiles 36, 37 and 38 to permit axial passage of the collet shoulder 148 past an indexing profile only if the fingers are permitted to flex radially inward. The internal bore enlargement 149 is dimensionally coordinated to the mandrel profile projection 148 to permit the radial inward flexure necessary for axial passage. The outside diameter of the mandrel projection 148 is also coordinated to the inside diameter of the collet fingers 147 so as to support the fingers 147 against radial flexure when the mandrel projections 148 are axially displaced from radial alignment with the finger enlargements 149. Hence, if the mandrel projection section 148 is not in radial alignment with the collet finger enlargement section 149, the collet sleeve will not pass any of the axial indexing profiles 36, 37 and 38 of the gravel pack body extension tube 23.

The internal bore of the collet sleeve 144 is formed with a female cylinder cam profile to receive the cam follower pin 146 whereby relative axial stroking between the collet sleeve 144 and the mandrel 142 rotates the sleeve about the longitudinal axis of the sleeve by a predetermined number of angular degrees. The cam profile provides two axial set positions for the collet sleeve relative to the mandrel 142. At a first set position, the mandrel blocking profile 148 aligns with the internal bore enlargement area 149 of the fingers. At the second set position, the mandrel blocking profile 148 aligns with the smaller inside diameter of the collet fingers 144. The mechanism is essentially the same as that utilized for retracting point writing instruments: a first stroke against a spring bias extends the writing point and a second, successive, stroke against the spring retracts the writing point.

Operating Sequence

Figures 4A, 4B, 4C, 4D, 4E:
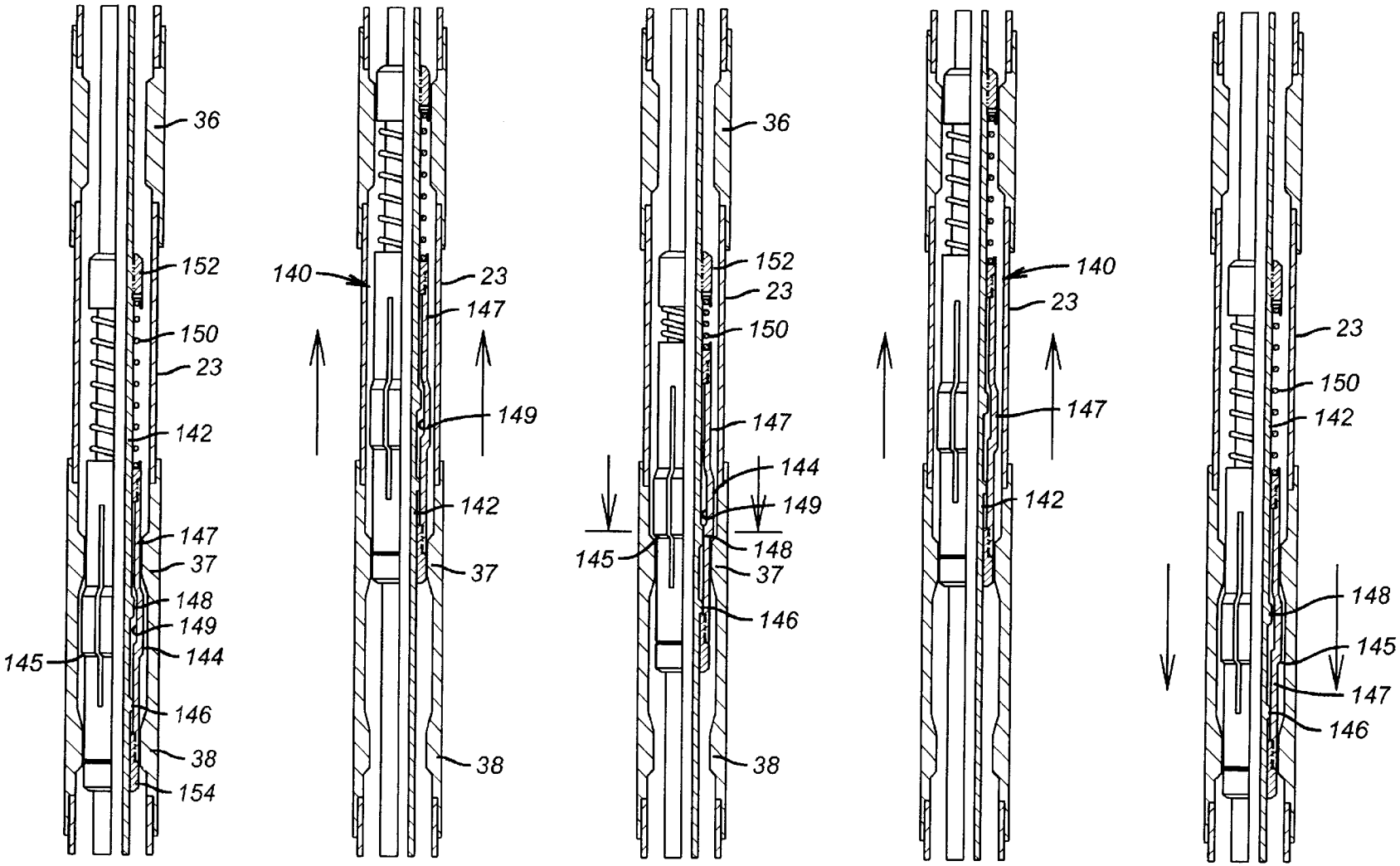
FIGS. 4A–4E schematically illustrate the operational sequence of the indexing collet.
Figure 5:
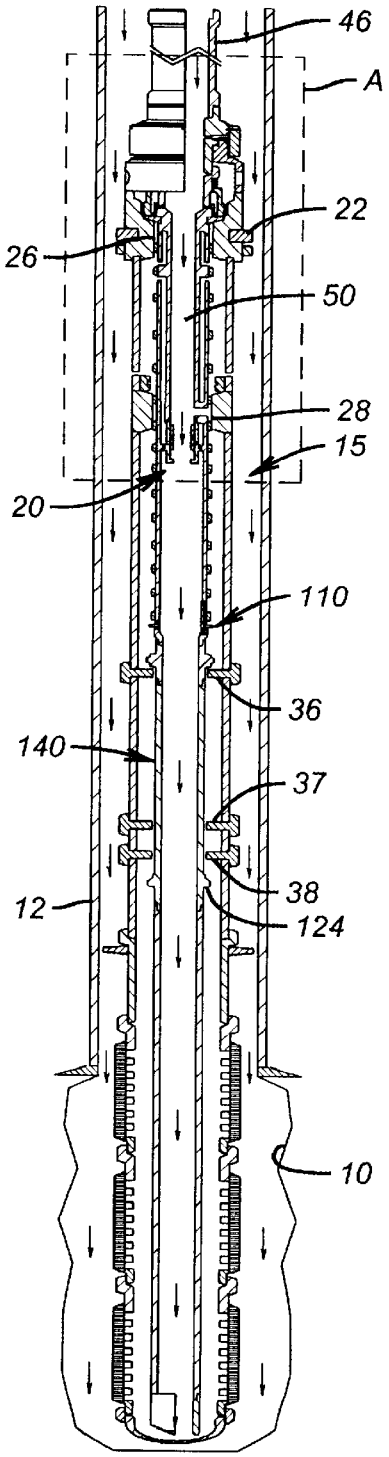
FIG. 5 is a sectional elevation of the gravel pack extension and the crossover tool in coaxial assembly for downhole positionment.
Figure 6:
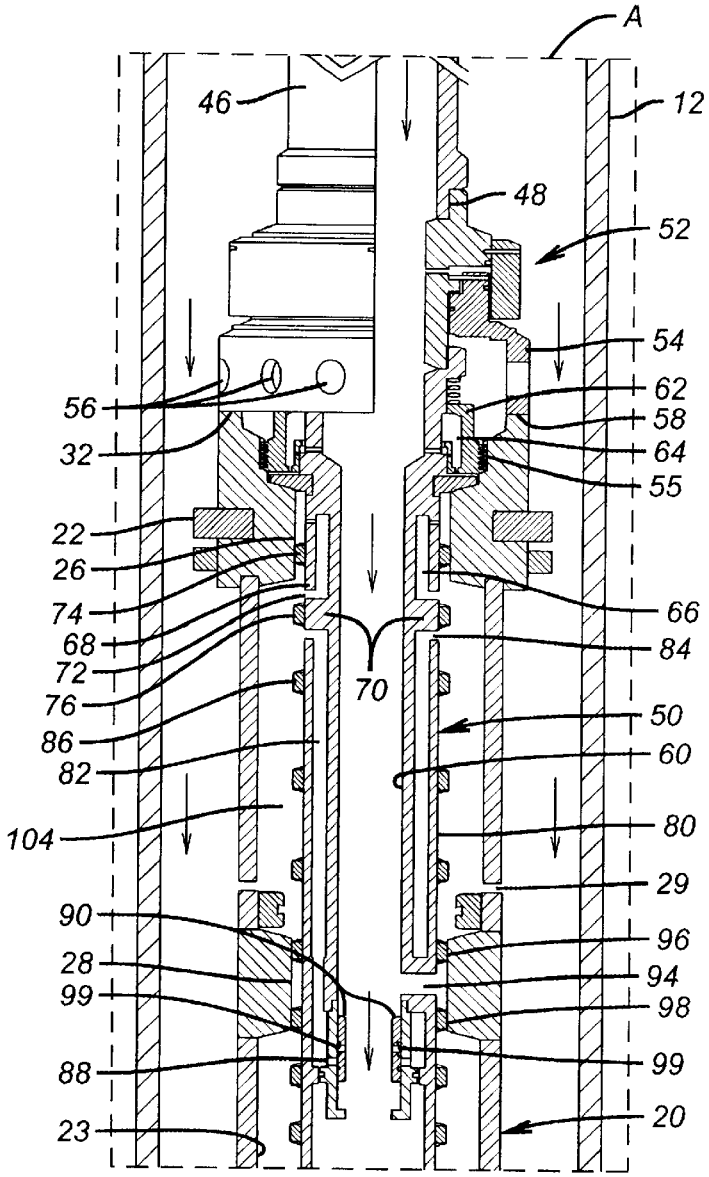
FIG. 6 is an enlargement of that portion of FIG. 5 within the detail boundary A.

Referring to FIGS. 5 and 6, in preparation for downhole positionment within a desired production zone, the gravel pack body 20 is attached to the crossover tool 50 by a threaded connection 55 for a gravel pack assembly 15. A threaded connection 48 also secures the gravel pack assembly 15 to the downhole end of the completion string 46. At this point, the packer seal 22 is radially collapsed thereby permitting the assembly 15 to pass axially along the bore of casing 12. The indexing collet 140 is set in the expanded alignment of FIG. 4A to align the mandrel profile 148 with the finger bore enlargement area 149. Consequently, the collet finger support shoulders 145 will constrict to pass through the tube 23 restriction profiles 36, 37 and 38.

Normally, the casing bore 12 and open borehole 10 below the casing 12 will be filled with drilling fluid, for example, which maintains a hydrostatic pressure head on the walls of the production zone. The hydrostatic pressure head is proportional to the zone depth and density of the drilling fluid. Since the packer seal is collapsed, this well fluid will flow past the packer 22 as the completion string is lowered into the well thereby maintaining the hydrostatic pressure head on the borehole wall. Consequently, placement of the assembly will have no pressure effect on the production zone. If desired, well fluid may be pumped down through the internal bore of the completion string 46 and back up the annulus around the assembly 15 and completion string in the traditional circulation pattern.

Figure 7:
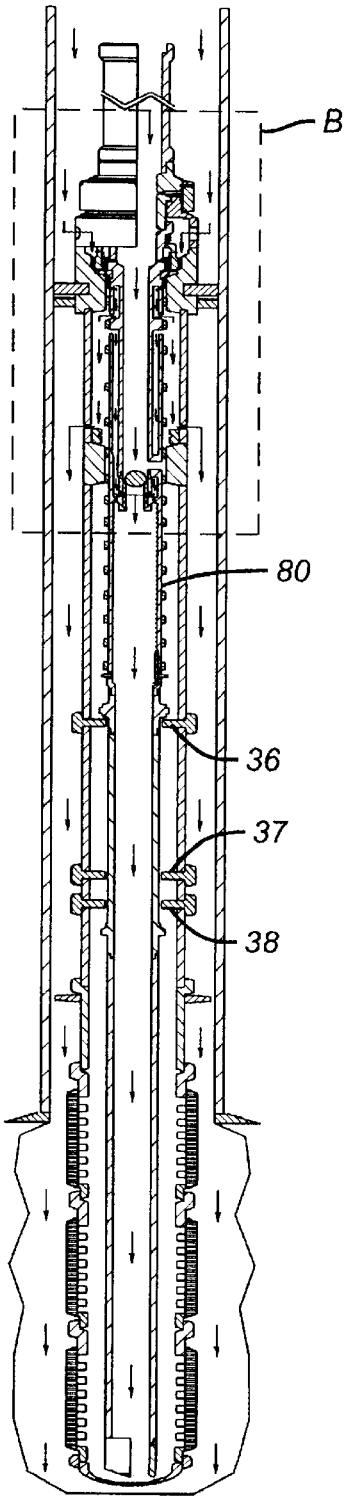
FIG. 7 is a sectional elevation of the gravel pack extension and the crossover tool in coaxial assembly suitable for setting the upper packer.
Figure 8:
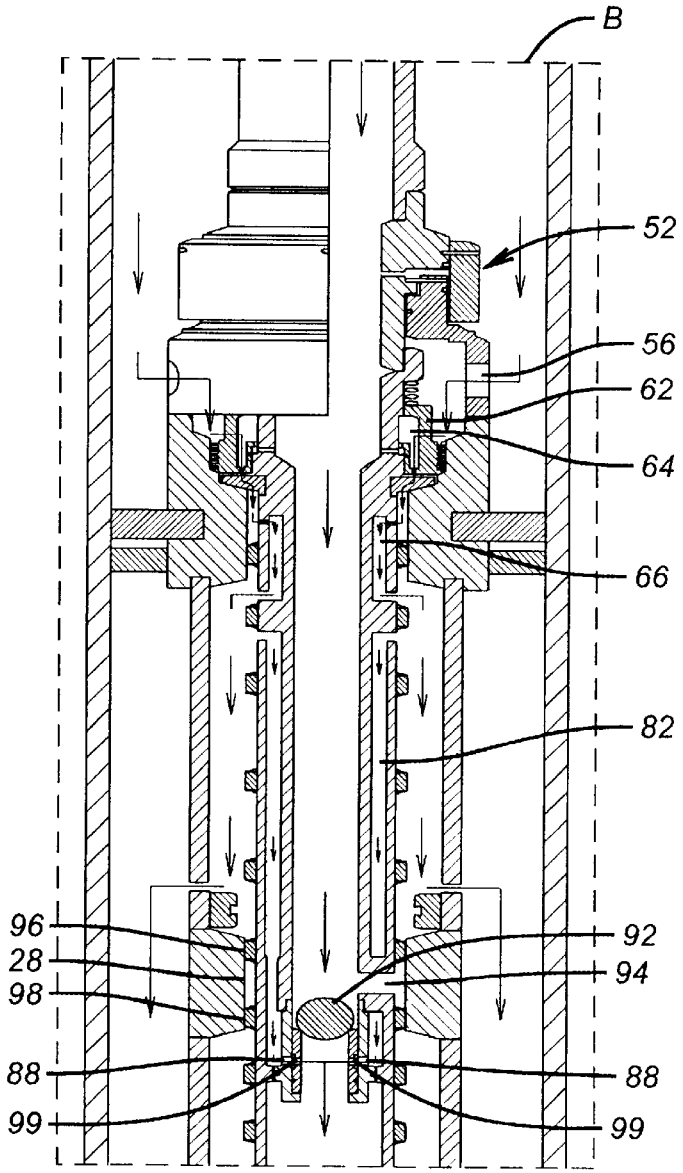
FIG. 8 is an enlargement of that portion of FIG. 7 within the detail boundary B.

When the completion string screens 16 are suitably positioned at the first index position along the borehole length, the check valve ball 92 is placed in the surface pump discharge conduit for pumped delivery along the completion string bore onto the check valve seat 90 as illustrated by FIGS. 7 and 8 to set the packer slips and secure the completion string location. Next, the packer seals 22 are expanded against the internal bore of casing 12 to block fluid flow along the casing annulus. It is to be noted that the by-pass port 94 of the crossover tool is located opposite from the lower seal bore 102 between the o-ring seals 96 and 98, thereby effectively closing the by-pass port 94. However, the restricted by-pass flow routes provided by the collar apertures 56, the void chamber 64, the upper by-pass chamber 66, and the upper by-pass flow channels 72 and 29 prevent pressure isolation of the production zone bore wall 10.

Next, the crossover tool 50, which is directly attached to the completion string 46, may be axially released from the gravel pack body 20 and positioned independently by manipulations of the completion string 46. The completion string 46 is first rotated to disengage the crossover tool threads 55 from the threads 30 of the gravel pack body 20. With the assembly threads 30 and 55 disengaged, the crossover tool 50 is lifted to a second index position relative to the gravel pack body 20. With respect to FIG. 4B, the completion string is lifted to draw the collet fingers 147 through a tube restriction profile. The draw load is indicated to the driller as well as the load reduction when the collet fingers clear the restriction. Additionally, the draw load on the collet sleeve strokes and rotates the sleeve to reset the follower pin in the sleeve cam profile. Accordingly, when the driller reverses and lowers the completion string, mandrel blocking profile 148 aligns with the smaller inside diameter of the collet fingers 147. The external finger shoulders 145 engage the tube profile to prevent further downhole movement of the completion string an positively locate the crossover tool 50 relative to the gravel pack body 20 at a second axial index position as shown by FIG. 4C.

Figure 9:
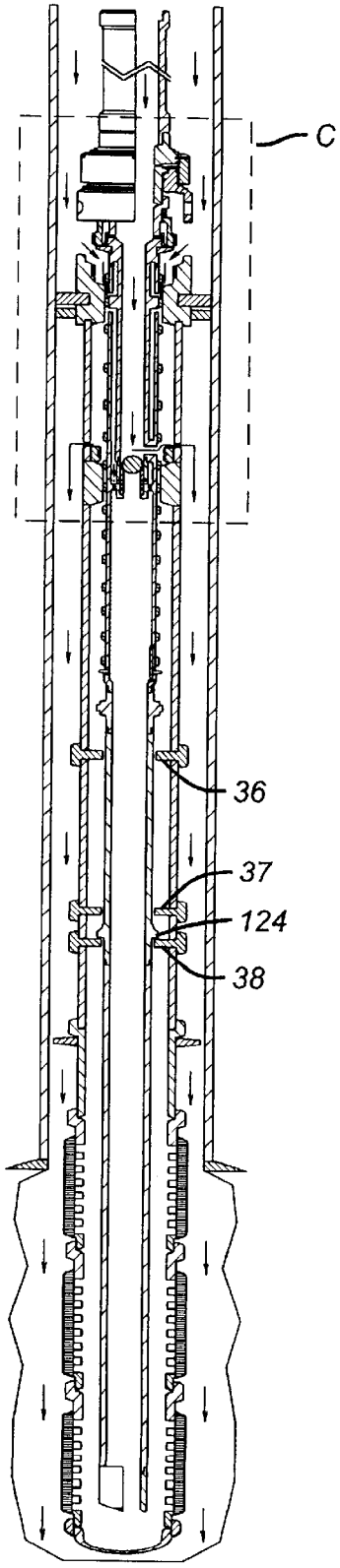
FIG. 9 is a sectional elevation of the gravel pack extension and the crossover tool in coaxial assembly suitable for testing the hydrostatic seal pressure of the upper packer.
Figure 10:
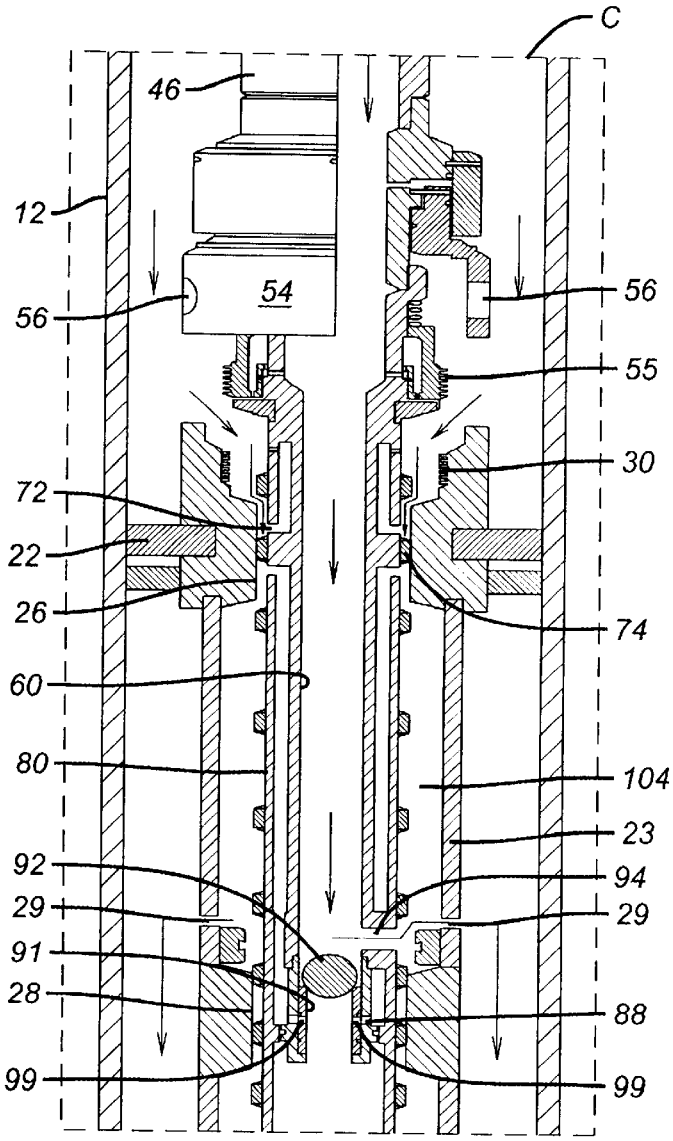
FIG. 10 is an enlargement of that portion of FIG. 9 within the detail boundary C.

With respect to the upper end of the crossover tool assembly 50 as illustrated by FIGS. 9 and 10, the ring-wall o-ring seal 74 engages the sealing surface 26 of the packer 22 to seal the annulus 104 between the gravel pack extension tube 23 and the crossover tool sleeve 80 from by-pass discharges past the packer 22. Simultaneously, the crossover flow port 94 from the internal bore of the inner tube 60 is opened into the annular volume 104 and ultimately, into the casing annulus via by-pass flow channels 29. Here, the seal integrity of packer 22 may be verified by elevating fluid pressure within the borehole below the packer 22.

Figure 11:
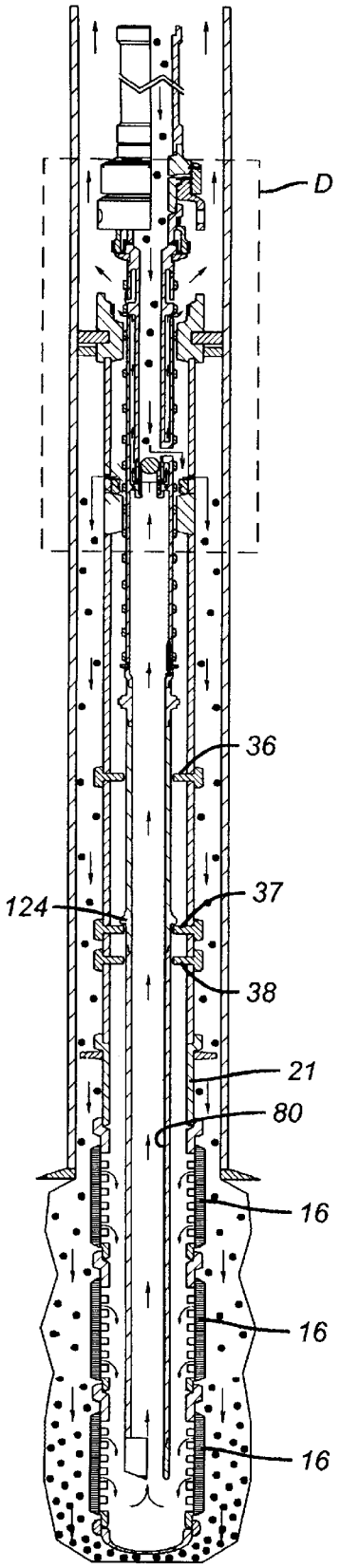
FIG. 11 is a sectional elevation of the gravel pack extension and the crossover tool in coaxial assembly suitable for circulating a gravel packing slurry into the desired production zone.
Figure 12:
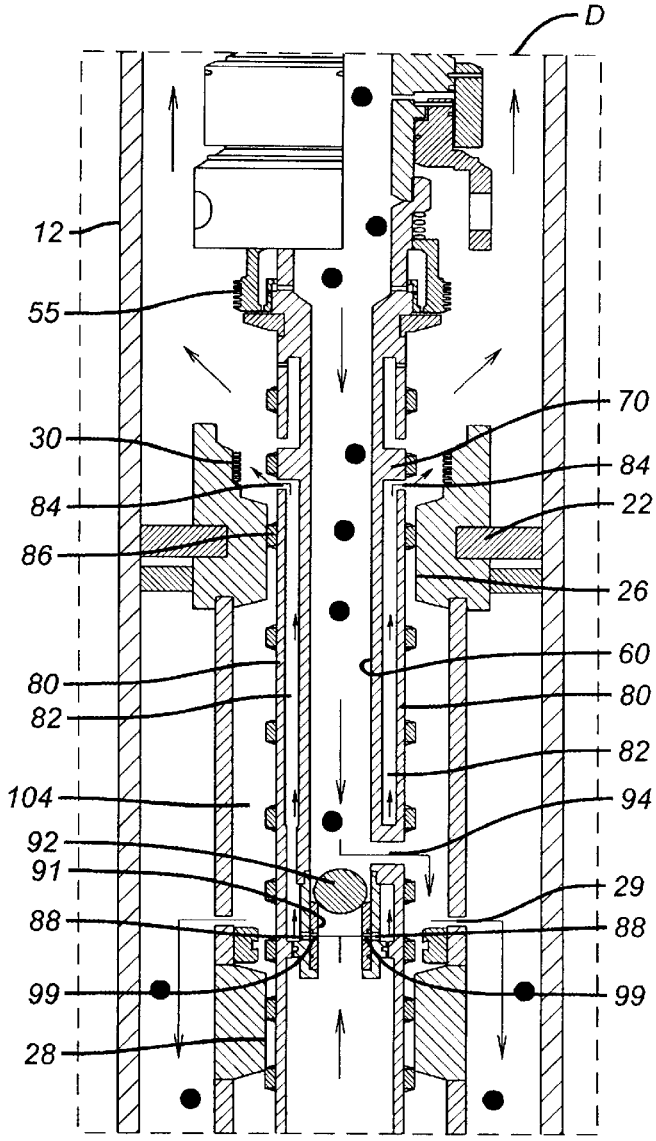
FIG. 12 is an enlargement of that portion of FIG. 11 within the detail boundary D.

With a confirmation of the seal and fixture of packer 22, the crossover tool 50 is axially indexed a third time to the relationship of FIGS. 11 and 12 where at the ring wall 70 and the lower by-pass flow channel 84 from the lower by-pass chamber 82 are positioned above the sealing surface 26. However, the o-ring seal 86 continues to seal the space between the sealing surface 26 and the lower sleeve 80. At this setting, a fluidized gravel slurry comprising aggregate and a fluid carrier medium may be pumped down the completion string 46 bore into crossover flow ports 94 above the check valve 90. From the crossover flow ports 94, the gravel slurry enters the annular chamber 104 and further, passes through the by-pass channels 29 into the casing annulus below the packer 22.

From the by-pass channels 29, the slurry flow continues along the casing annulus into the open borehole annulus within the production zone 18. Fluid carrier medium passes through the mesh of screen elements 16 which block passage of the slurry aggregate constituency. Accordingly, the aggregate accumulates around the screen elements 16 and, ultimately, the entire volume between the raw wall of the open bore 10 and the screens 16.

Upon passing the screens 16, carrier medium enters the gravel pack extension flow pipe 21 and the internal bore of lower sleeve 80. Below the check valve 90, the carrier medium enters the lower by-pass chamber 82 through the check valve by-pass flow channels 88. At the upper end of the by-pass chamber 82, the carrier medium flow is channeled through the lower by-pass 84 into the casing annulus above the packer 22. The upper casing annulus conducts the carrier medium flow back to the surface to be recycled with another slurry load of aggregate.

Figure 13:
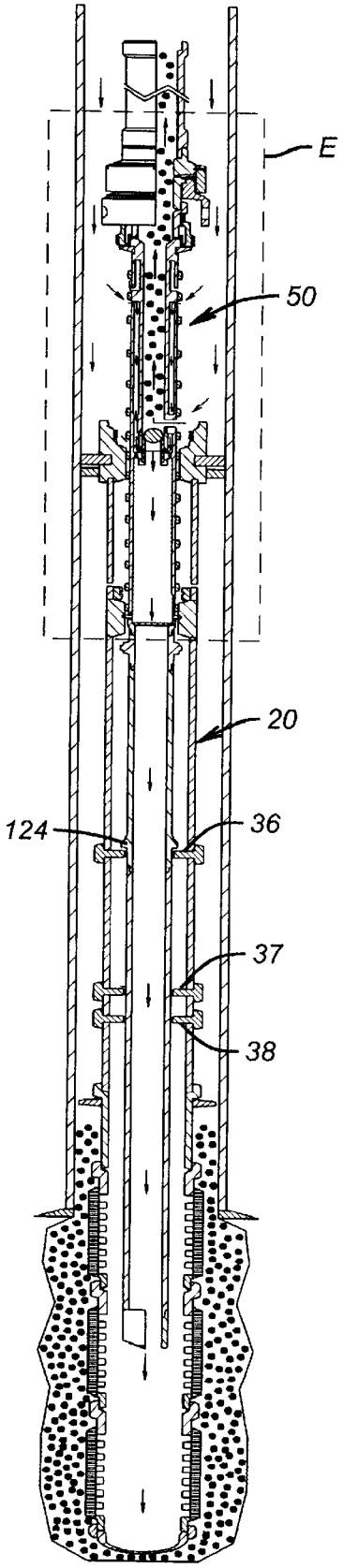
FIG. 13 is a sectional elevation of the gravel pack extension and the crossover tool in coaxial assembly suitable for a flush circulation of the setting tool pipe string.
Figure 14:
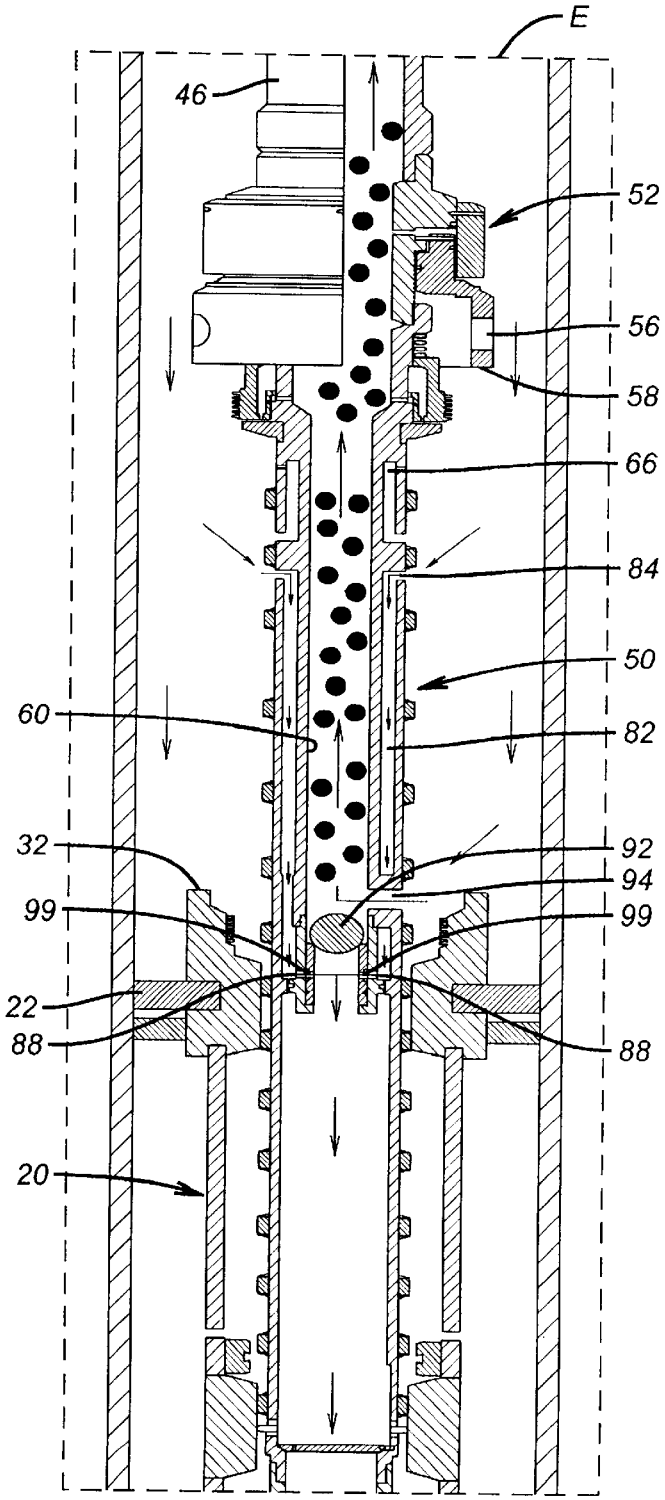
FIG. 14 is an enlargement of that portion of FIG. 13 within the detail boundary E.

Unless it is possible predetermine the exact volume of aggregate necessary to fill the open hole annulus within the production zone 18, excess aggregate will frequently remain in the completion string bore when the gravel pack 24 is complete. Usually, it is desirable to flush any excess aggregate in the completion string bore from the completion string before withdrawing the completion string and attached crossover tool. With reference to FIGS. 13 and 14, the crossover tool 50 is withdrawn from the gravel pack extension 20 to a fourth index position at which the crossover port 94 is open directly to the casing annulus above the upper packer 22. Unslurried well fluid is pumped into the casing annulus in a reverse circulation mode. The reverse circulating fluid enters the inner tube 60 bore above the check valve 90 to fluidize and sweep any aggregate therein to the surface. However, to maintain the desired hydrostatic pressure head on the open hole production zone, reverse circulating well fluid also enters the lower by-pass chamber 82 through the lower by-pass flow channel 84. Fluid is discharged from the chamber 82 through the check valve by-pass flow channels 88 into the volume below the packer 22 thereby reducing any pressure differential across the packer.

With the gravel pack 24 in place, the crossover tool 50 may be completely extracted from the gravel pack body 20 with the completion string and replaced by a terminal sub 44 and production pipe 42, for example.

Utility of the anti-swabbing tool with the crossover assembly 50 arises with the circumstance of unexpected loss of well fluid into the formation after the gravel packing procedure has begun. Typically, a portion of filter cake has sluffed from the borehole wall and must be replaced by an independent mud circulation procedure. As a first repair step, fluid loss from within the completion string bore must be stopped. This action is served by releasing the flapper 117 to plug the bore notwithstanding the presence of the ball plug 92 on the valve seat 90.

The foregoing detailed description of our invention is directed to the preferred embodiments of the invention. Various modifications may appear to those of ordinary skill in the art. It is accordingly intended that all variations within the scope and spirit of the appended claims be embraced by the foregoing disclosure.

What is claimed:

1. In a method of depositing gravel pack aggregate within a hydrocarbon well production zone, said method comprising the preparation steps of:

a. providing fluid in a wellbore to exert a hydrostatic pressure overburden against a production zone wall portion of said wellbore;

b. providing a completion string in said wellbore, said completion string having a crossover flow assembly, a central flow channel therethrough and a gravel screen disposed between said central flow channel and said production zone wall;

c. providing an annulus obstruction to fluid flow in a substantially annular portion of said wellbore around said completion string, said annulus obstruction being disposed proximately of said crossover flow assembly and above said gravel screen portion;

d. providing a pipe bore obstruction to fluid flow through said central flow channel proximate of said crossover flow assembly; and, e. providing a first fluid by-pass channel in said crossover flow assembly across said annulus obstruction to maintain a hydrostatic pressure overburden on said production zone wall when said annulus obstruction and said pipe bore obstruction are simultaneously provided.

2. A method as described by claim 1 wherein said crossover flow assembly comprises a packer extension assembled substantially coaxially with a crossover tool, said coaxial assembly having a plurality of functions that are each directed by respective axial positions of said crossover tool relative to said packer extension.

3. A method as described by claim 2 wherein said crossover tool is placed at a first axial position to close said first fluid by-pass channel and open a second fluid by-pass channel between said central flow channel above said pipe bore obstruction and said wellbore annulus below said annulus obstruction to test the integrity of said annulus obstruction by increasing the overburden on said production zone.

4. A method as described by claim 3 wherein said crossover tool is placed at a second axial position that continues the opening of said second fluid by-pass channel and opens a third fluid by-pass channel between said central flow channel below said pipe bore obstruction and said wellbore annulus above said annulus obstruction for circulation of a fluidized slurry of aggregate into said wellbore annulus proximate of said production zone.

5. A method as described by claim 4 wherein said crossover tool is placed at a third axial position that continues the opening of said second fluid by-pass channel and opens a fourth fluid by-pass channel between said wellbore annulus above said annulus obstruction and said central flow channel below said pipe bore obstruction for reverse flow fluid circulation to flush from said pipe bore residual aggregate remaining above said pipe bore obstruction and simultaneously continue overburden pressure on said production zone wall.

6. A method of depositing gravel pack aggregate within a hydrocarbon well production zone to form a gravel packing of said zone around a production conduit, said method comprising the steps of:

a. providing a first fluid conduit having selectively deployed wellbore sealing means proximate of a first conduit upper end, aggregate slurry screening means proximate of a first conduit lower end and upper and lower tube sealing surfaces internally therein, said tube sealing surfaces being axially displaced to provide a fluid flow volume there between;

b. providing a second fluid conduit having a first fluid flow channel axially there through and upper and lower by-pass flow channels coaxially around said first flow channel, said first fluid flow channel having valve means therein to selectively obstruct fluid flow along said first flow channel and partition means to isolate axially adjacent by-pass flow channels;

c. coaxially assembling said second fluid conduit with said first fluid conduit at a first relative position whereby an outer perimeter surface of said second fluid conduit is in fluid sealing engagement with the upper and lower tube sealing surfaces of said first fluid conduit;

d. securing said second conduit to a lower distal end of a tool string having a tool string flow channel axially therein with said first fluid flow channel in substantially coaxial flow alignment with said tool string flow channel;

e. manipulating said tool string to position the coaxial assembly of said first and second conduits within a wellbore whereby said slurry screening means is proximate of said production zone;

f. deploying said wellbore sealing means to obstruct fluid flow in a wellbore annulus around said coaxial assembly of said first and second conduits;

g. engaging said first fluid flow channel valve means to obstruct fluid flow along said first fluid flow channel; and, h. providing a fluid flow path past said wellbore sealing means between an upper portion of said wellbore annulus and a lower portion of said wellbore annulus through said upper by-pass flow channel to provide pressure continuity within said wellbore between said upper and lower wellbore annulus portions.

7. A method as described by claim 6 wherein said second fluid conduit is released from said first fluid conduit for axial displacement of said second fluid conduit to a second axial position whereat a first by-pass port in said first fluid flow channel above said valve means directs a slurry flow of aggregate along said first fluid flow channel past said valve means and into said wellbore below said wellbore sealing means and a second by-pass port in said first fluid flow channel below said valve means directs screen passed filtrate from said slurry into said wellbore above said wellbore sealing means thereby depositing said aggregate within said wellbore around said screen.

8. A method as described by claim 7 wherein said second fluid conduit is axially displaced to a third axial position whereat said first by-pass port is open between said first fluid flow channel and the wellbore annulus above said wellbore sealing means and a fluid flow path along said lower by-pass flow channel connects said wellbore annulus above said wellbore sealing means with the wellbore annulus below said wellbore sealing means for pressure continuity across said wellbore sealing means.

9. Means for practicing the process of claim 1 comprising a borehole gravel packing assembly that includes a gravel packing body having a first fluid flow tube, said first fluid flow tube extending axially between the said annulus obstruction of a well annulus packer positioned proximately of one end of said first fluid flow tube and a first bore opening proximate of an opposite end thereof, the bore of said first fluid flow tube having a pair of axially separated, circumferential sealing surfaces proximate of said one end and a plurality of axially separated, positioning tool engagement profiles between said sealing surfaces and said opposite end.

10. A gravel packing assembly as described by claim 9 wherein said crossover flow assembly has a selectively disengaged position of coaxial alignment within the bore of said first fluid flow tube and to said sealing surfaces to form an annular flow channel between said sealing surfaces.

11. A gravel packing assembly as described by claim 10 wherein said crossover flow assembly includes an axial positioning tool for selectively placing said crossover flow assembly at each of a plurality of axially separated positions corresponding to the axial separation of said positioning tool engagement profiles.

12. A gravel packing assembly as described by claim 11 wherein said crossover flow assembly includes said central flow channel therein and a pipe bore obstruction seat within the central flow channel for retaining a selectively engaged bore flow plug thereon.

13. A gravel packing assembly as described by claim 12 wherein said crossover flow assembly further comprises first and second auxiliary flow channels that are substantially parallel with said central flow channel and are axially separated from each other.

14. A gravel packing assembly as described by claim 13 having a first flow path along said first auxiliary channel between the substantially annular portion of said wellbore above said packer and said annular flow channel between said sealing surfaces.

15. A gravel packing assembly as described by claim 14 wherein said first flow path continues from said annular flow channel through first flow tube apertures and into a substantially annular portion of said wellbore below said packer.

16. A gravel packing assembly as described by claim 13 having a second flow path along said second auxiliary channel between said annular flow channel between said sealing surfaces and the central flow channel below said pipe bore obstruction seat when said bore flow plug is retained thereon.

17. A gravel packing assembly as described by claim 16 wherein said crossover flow assembly has a crossover flow aperture between said central flow channel and said annular flow channel between said sealing surfaces and above said pipe bore obstruction seat.

18. A gravel packing assembly as described by claim 11 wherein said crossover flow assembly further includes an anti-swabbing tool between said axial positioning tool and said pipe bore obstruction seat.

19. An axial positioning tool as described by claim 11 comprising:

a. a tubular mandrel having an axial bore therein and first and second profiled projections from a substantially cylindrical outside surface thereof;

b. a sleeve that is coaxially assembled about said mandrel and confined to axial displacement along said mandrel between first and second axially separated positions along said mandrel;

c. a spring positioned to bias said sleeve along said mandrel toward said first position;

d. a plurality of longitudinal slots in said sleeve distributed around the sleeve perimeter to define longitudinal collet fingers therebetween, said collet fingers having axially separated, peripheral segments respective to both large and small internal diameters, said collet fingers also having axially separated, peripheral segments respective to both large and small external diameters; and e. a cylindrical cam profile on said sleeve having operative cooperation with the second profiled projection from said mandrel whereby an axial stroking of said sleeve relative to said mandrel partially rotates said sleeve about said axis to a selected axial index position.

20. An axial positioning tool as described by claim 19 wherein said first mandrel projection is aligned with the large internal diameter segments of said collet fingers whereby said fingers may be structurally constricted.

21. An axial positioning tool as described by claim 20 wherein said first mandrel projection is aligned with the small internal diameter segments of said collet fingers whereby said fingers cannot be structurally constricted.

22. An anti-swabbing tool as described by claim 18 comprising:

a. a tubular mandrel having an axial bore therein and a flapper seat within said bore;

b. a flapper having a pivotal attachment to said mandrel for rotation onto said seat, said flapper having a structural projection therefrom by which said flapper is held from said seat against a spring bias;

c. a sliding sleeve assembled coaxially around said mandrel, said sleeve having a latch device for meshing with said flapper projection to hold said flapper from said seat against said spring bias;

d. a selectively sheared fastener for securing said sleeve at a relative axial position whereat said latch device is meshed with said flapper projection; and e. a collet assembly coaxially around said mandrel to bear upon said sleeve for selectively shearing said fastener.

* * * * *

UNITED STATES PATENT AND TRADEMARK OFFICE

CERTIFICATE OF CORRECTION

PATENT NO. : 6,382,319 B1
DATED : May 7, 2002
INVENTOR(S) : Leo E. Hill, Jr. et al.

It is certified that error appears in the above-identified patent and that said Letters Patent is hereby corrected as shown below:

Title page,
Item [63], Related U.S. Application Data, after now Pat. No., please delete "6,203,901" and insert therefor -- 6,230,801 --.

Signed and Sealed this

Nineteenth Day of November, 2002

*Attest:*

*Attesting Officer*

JAMES E. ROGAN
*Director of the United States Patent and Trademark Office*